US006550288B2

(12) United States Patent
Browder, Jr. et al.

(10) Patent No.: US 6,550,288 B2
(45) Date of Patent: Apr. 22, 2003

(54) LOWER TORSO GARMENT WITH INTEGRAL PANTY AND METHOD OF MAKING SAME

(75) Inventors: George A. Browder, Jr., Winston-Salem, NC (US); Mac Lewis, High Point, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 09/904,818

(22) Filed: Jul. 13, 2001

(65) Prior Publication Data

US 2003/0019251 A1 Jan. 30, 2003

(51) Int. Cl.[7] ..... D04B 1/24
(52) U.S. Cl. ..... 66/177
(58) Field of Search ..... 66/169 R, 170, 66/171, 172 R, 175, 176, 177, 173

(56) References Cited

U.S. PATENT DOCUMENTS 3,678,514 A * 7/1972 Safrit ..... 2/212
4,872,324 A * 10/1989 Rearwin et al. ..... 66/172 E
5,052,058 A * 10/1991 Mueller ..... 2/227
5,517,832 A * 5/1996 Kristensen ..... 2/406
5,553,468 A * 9/1996 Osborne ..... 2/73
5,605,060 A * 2/1997 Osborne ..... 2/69
5,746,068 A * 5/1998 Popa et al. ..... 2/213
5,836,179 A * 11/1998 van Laar ..... 66/171
5,978,971 A * 11/1999 Wald ..... 2/227
6,009,558 A * 1/2000 Rosch et al. ..... 2/212
6,125,664 A * 10/2000 Browder, Jr. ..... 450/92
6,164,094 A * 12/2000 Lonati et al. ..... 66/172 R
6,178,784 B1 * 1/2001 Marley, Jr. ..... 450/92

* cited by examiner

*Primary Examiner*—Danny Worrell
(74) *Attorney, Agent, or Firm*—Ohlandt, Greeley, Ruggiero & Perle, L.L.P.

(57) ABSTRACT

There is provided lower torso garments that have an integral panty or brief, circularly knit garment blanks for such lower torso garments, and methods of producing lower torso garments that have an integral panty or brief from circularly knit garment blanks. Lower torso garments according to the present invention have an outer layer and an inner layer. The inner layer has an integral panty. The garment is formed from a blank that is circularly knitted with a welt band seamlessly joined to a first fabric segment forming the outer layer and a second fabric segment forming the inner layer with the integral panty.

21 Claims, 2 Drawing Sheets

LOWER TORSO GARMENT WITH INTEGRAL PANTY AND METHOD OF MAKING SAME

BACKGROUND OF THE INVENTION

1. Field of the Invention

The present invention generally relates to clothing and methods for making clothing. More particularly, the present invention relates to lower torso garments formed from garment blanks that are knitted on a circular knitting machine.

2. Description of the Prior Art

The use of circularly knit garment blanks in the manufacture of undergarments is known. For example, in reference to a brassiere, U.S. Pat. No. 4,531,525 to Richards describes the use of a circular knitting machine to produce a seamless garment blank. To assemble a brassiere, the seamless garment blank is cut, folded, and sewn. Brassieres produced using the procedure of the Richards patent will have a single type of fabric.

U.S. Pat. Nos. 5,553,468 and 5,592,836, both to Osborne, describe brassieres made from circular-knit garment blanks. Each circular-knit garment blank has a welt at one end with a fabric portion integrally knit thereto. To assemble the brassiere, neck and armhole areas are cut in the fabric segment to define front and rear strap portions, which are sewn together to complete the formation of the brassiere. Like the brassieres of the Richards patent, brassieres produced using the procedure of the Osborne patents will have a single type of fabric.

U.S. Pat. No. 5,605,060 to Osborne provides a circular-knit body suit with a breast supporting portion, a middle torso portion, and a lower torso portion. The middle torso portion is knit with a cross-stretch that is less than that of the breast supporting portion.

SUMMARY OF THE INVENTION

It is an object of the present invention to provide a lower torso garment having an integral panty or brief.

It is another object of the present invention to provide a circularly knit garment blank from which such a lower torso garment may be produced.

It is still another object of the present invention to provide a method of making a lower torso garment with an integral panty or brief from a circularly knit garment blank.

These and other objects and advantages of the present invention are achieved by a lower torso garment that has an integral panty or brief, a circularly knit garment blank for such lower torso garment, and methods of producing a lower torso garment that has an integral panty or brief from a circularly knit garment blank. A lower torso garment according to the present invention has an outer layer and an inner layer. The inner layer has an integral panty. The garment is formed from a blank that is circularly knitted with a welt band seamlessly joined to a first fabric segment forming the outer layer and a second fabric segment forming the inner layer with the integral panty.

Other and further objects, advantages and features of the present invention will be understood by reference to the following specification in conjunction with the accompanying drawings.

DETAILED DESCRIPTION OF THE INVENTION

Figure 1:
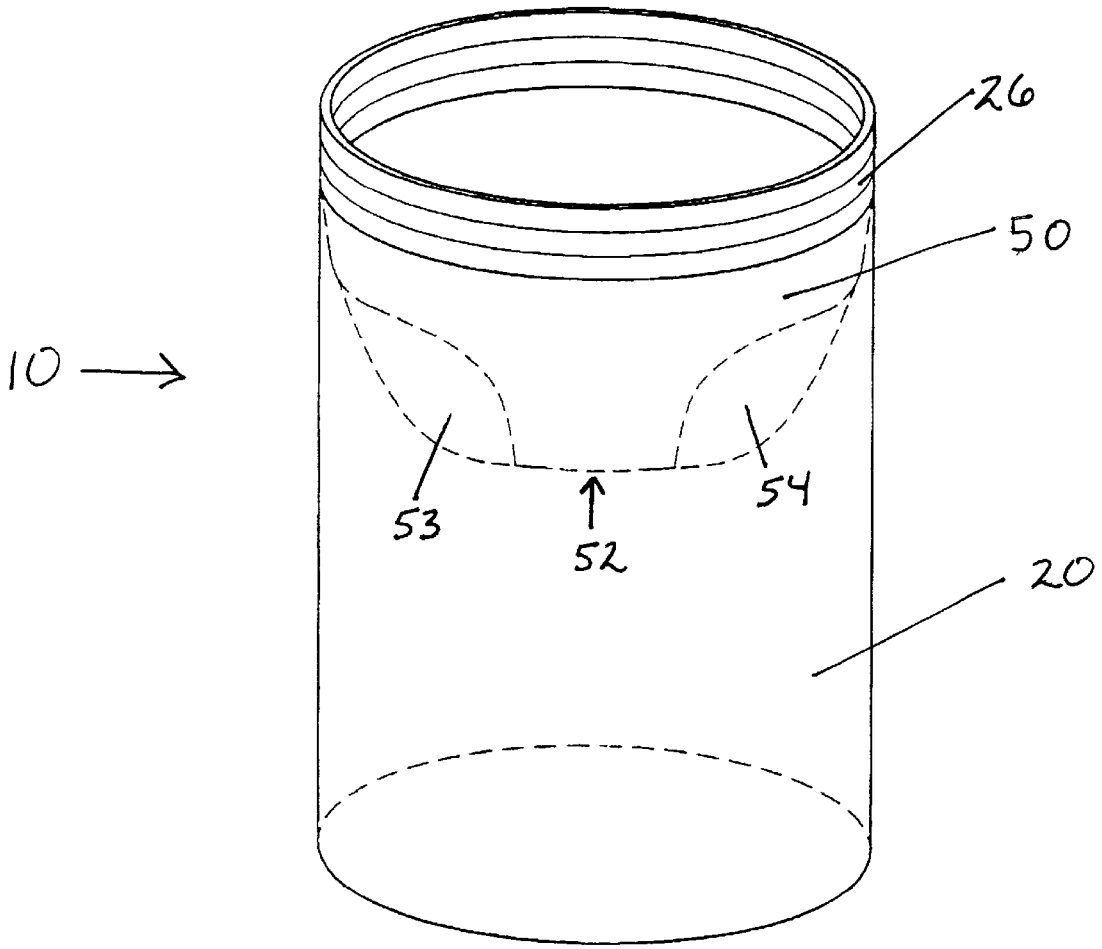
FIG. 1 is a lower torso garment according to the present invention.

Referring to drawings and, in particular, FIG. 1, there is provided a lower torso garment according to the present invention generally represented by numeral 10. As used herein, the phrase "lower torso garment" means any article of clothing that covers the lower torso, including outerwear, such as pants, shorts, and skirts, as well as underwear, such as bodysuits, briefs, tights, slips, and trousers.

As shown, lower torso garment 10 is a slip formed of an outer fabric layer 20, an inner fabric layer 50, and a turned welt or band 26. Outer fabric layer 20 and inner fabric layer 50 are integrally joined to turned welt 26 in a seamless manner. Preferably, outer fabric layer 20 and inner fabric layer 50 are produced using different types of fabrics. In particular, outer fabric layer 20 is preferably produced using a fabric that has the desired aesthetics and provides durability, support, and/or strength to lower torso garment 10. The inner fabric layer 50 is preferably produced using a fabric that provides comfort and/or support to the wearer of lower torso garment 10. Such a construction provides a garment that is aesthetically pleasing, durable, and comfortable for the wearer.

Outer fabric layer 20 is preferably made of a flat and/or stretch yarn of any suitable material. The yarn may be synthetic (e.g., nylon), natural (e.g., cotton), elastomeric (e.g., spandex), or a combination thereof. The yarn or combination of yarns forms a pattern that is preferably in the range about 70/1 to about 30/1 cotton count or about 50 to about 180 denier. More preferably, the yarn or combination of yarns of outer fabric layer 20 forms a pattern that is in the range about 100 to about 150 denier. The knit stitches in outer fabric layer 20 can be any type of knit stitches that gives lower torso garment 10 the desired aesthetics and/or functionality. For example, outer fabric layer 20 may have lines, a floral pattern, may be shear, or have any combination of consumer desired visual presentations. Traditional knit stitches for use in the present invention include, plain, tuck, and/or float stitches.

Significantly, inner fabric layer 50 includes an integral panty with crotch portion 52 and leg openings 53, 54. Like outer fabric layer 20, inner fabric layer 50 may have yarns that are synthetic, natural, elastomeric, or a combination thereof. Inner fabric layer 50 is preferably made with yarn that provides softness, comfort and desired wicking properties. For example, inner fabric layer 50 may be made of nylon microfiber yarn having a denier about 40 to about 120 or cotton yarn having a cotton count about 40/1 to about 60/1. The knit construction of inner fabric layer 50 may be any combination of conventional knit stitches with the potential additional yarns or knit constructions added in strategically engineered areas to provide support or lift to the wearer's body. Such strategic areas are, for example, under the wearer's buttocks.

Turned welt 26 forms a band that connects together outer fabric layer 50 and inner fabric layer 20. For example, as shown in FIG. 1, welt 26 is a waistband for lower torso garment 10. Turned welt or waistband 26 preferably has an elastomeric yarn in combination with other synthetic or natural yarns. More preferably, turned welt 26 is made of a combination of either direct knit spandex or nylon-covered spandex and nylon. Most preferably, turned welt 26 is made of about 120 to about 420 denier nylon spandex (bare or covered) and nylon. Such a high denier spandex is preferred in order to make certain that lower torso garment 10 stays in place on the wearer's body.

Figure 2:
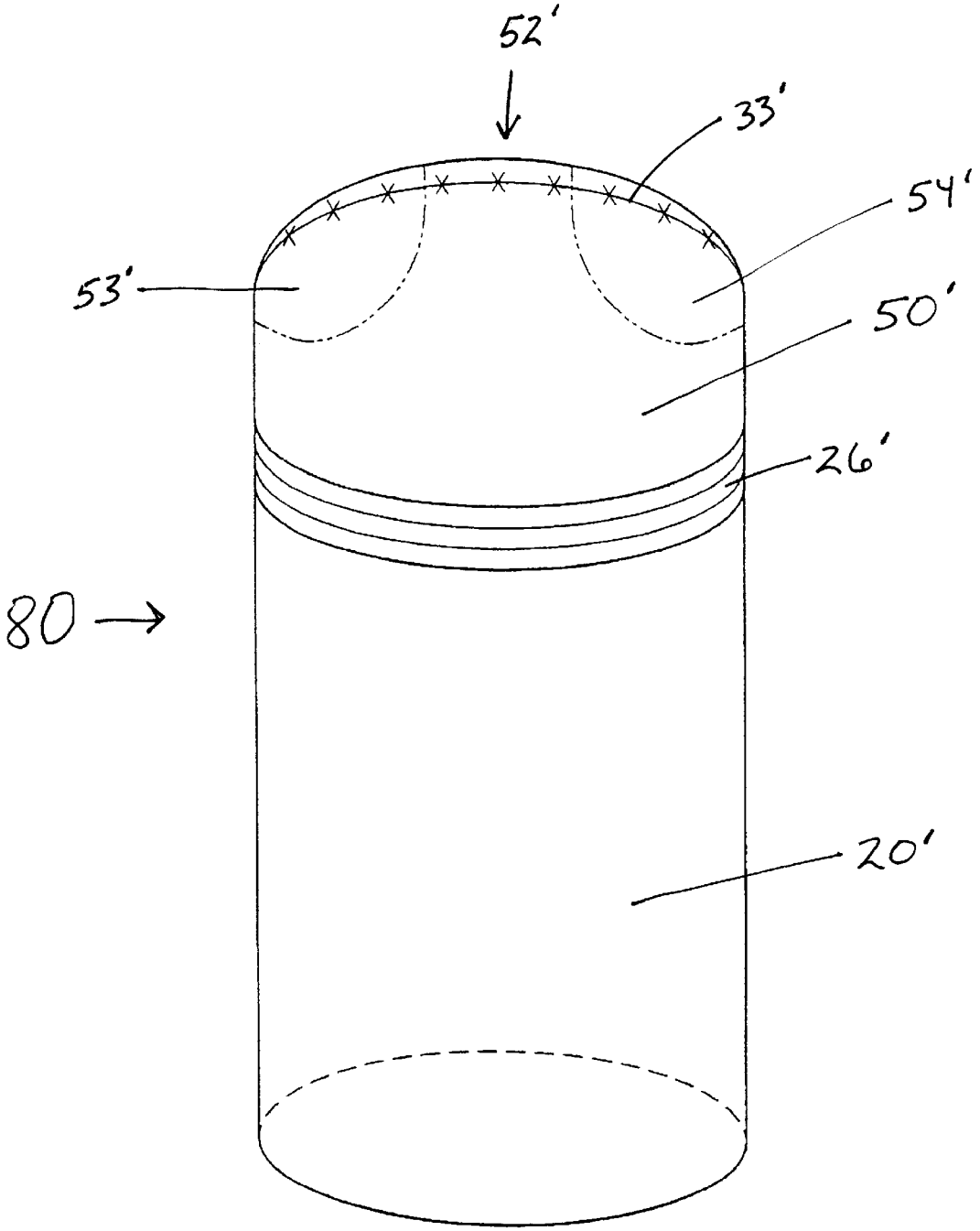
FIG. 2 is a blank used for manufacturing the lower torso garment of FIG. 1.

Referring to FIG. 2, lower torso garment 10 is produced from a garment blank 80 that is formed by a high-speed circular knitting machine. Garment blank 80 has fabric portions that correspond to the fabric layers of lower torso garment 10. For that reason, reference characters corresponding to those used above with reference to FIG. 1 will be applied in FIG. 2 with a prime notation.

Garment blank 80 has a turned welt 26', a first fabric portion 20', and a second fabric portion 50'. First and second fabric portions 20', 50' are seamlessly joined to turned welt 26'.

The courses for turned welt 26' preferably involve a course program that has miss-stitch or float stitch construction to provide a proper common waistband. In this construction, loops in certain courses are held without additional yarns being taken and then knit into subsequent courses, thereby gathering the courses together and providing the characteristics of a turned welt. The courses, however, may be knit in any number of plain or simple stitch versions.

First fabric portion 20' and second fabric portion 50' are preferably formed mostly with simple knit constructions, such as plain, tuck, pearl and combinations thereof. Welt knit stitches may suitably be used to provide special features at various areas of first fabric portion 20'.

First fabric portion 20' and second fabric portion 50' are preferably knitted with different types of fabrics. In particular, first fabric portion 20' is preferably produced with a fabric that is useful as an outer fabric layer for lower torso garment 10. As such, first fabric portion 20' preferably has a fabric type that provides durability, support, and/or strength. Second fabric portion 50' is preferably produced with a fabric that is useful as an inner fabric layer for lower torso garment 10. As such, second fabric portion 20' preferably has a fabric type that provides comfort and/or support.

To produce lower torso garment 10 from blank 80, second fabric portion 50' is sewn at least partially closed at edge 33'. Leg openings are formed by cutting and removing areas 53' and 54' from second fabric portion 50'. Crotch portion 52' is between the leg openings. Outer fabric portion 20' is then folded over inner fabric portion 50' (or vise versa), thereby creating outer fabric layer 20 and inner fabric layer 50 having an integral panty. Stitching may be added to lower torso garment 10 to attach or tack one or more areas of outer fabric layer 20 to corresponding areas of inner fabric layer 50 so that the double layer arrangement is maintained between outer fabric layer 20 and inner fabric layer 50. In addition, other aesthetic features (e.g., lace) and hygienic features (e.g., crotch liners) known in the art may be sewn or affixed to lower torso garment 10.

Lower torso garment 10 is made from a circularly knit garment blank 80 that is formed on a high-speed circular knitting machine. Lower torso garment has a double fabric layer, with the inner fabric layer 50 forming an integral panty and preferably having certain features that provide softness, comfort, and wicking.

The present invention having been thus described with particular reference to the preferred forms thereof, it will be obvious that various changes and modifications may be made therein without departing from the spirit and scope of the present invention as defined in the appended claims.

What is claimed is:

1. A lower torso garment comprising:

a circularly knit turned welt having a lower torso encircling shape;

a circularly knit outer fabric layer seamlessly joined to said turned welt and having a lower torso encircling shape; and a circularly knit inner fabric layer seamlessly joined to said turned welt and having a lower torso encircling shape, said inner fabric forming an integral panty.

2. The lower torso garment according to claim 1, wherein said outer fabric layer has a cotton count about 50/1 to about 30/1.

3. The lower torso garment according to claim 1, wherein said outer fabric layer has a denier of about 50 to about 180.

4. The lower torso garment according to claim 1, wherein said inner fabric layer has a cotton count about 70/1 to about 30/1.

5. The lower torso garment according to claim 1, wherein said inner fabric layer has a denier of about 40 to about 120.

6. The lower torso garment according to claim 1, wherein said turned welt comprises an elastomeric yarn.

7. The lower torso garment according to claim 6, wherein said elastomeric yarn has a denier of about 150 to about 420.

8. The lower torso garment according to claim 1, wherein said outer fabric layer is of a different fabric type than said inner fabric layer.

9. The lower torso garment according to claim 8, wherein said outer fabric layer is of a fabric type chosen for its aesthetic appeal and durability, and wherein said inner fabric layer is of a fabric type chosen for comfort and performance.

10. A blank for the manufacture of a lower torso garment, said blank comprising:

a circularly knit welt having a lower torso encircling shape;

a circularly knit first fabric segment seamlessly joined to said welt and having a lower torso encircling shape; and a circularly knit, tubular second fabric segment having (i) a lower edge seamlessly joined to said welt, and (ii) an upper edge having at least two portions thereof sewn together, whereby said second fabric segment is adapted to form an integral panty.

11. The blank according to claim 10, wherein said first fabric segment has a cotton count about 70/1 to about 30/1.

12. The blank according to claim 10, wherein said first fabric segment has a denier of about 50 to about 180.

13. The blank according to claim 10, wherein said second fabric segment has a cotton count about 70/1 to about 30/1.

14. The blank according to claim 10, wherein said second fabric segment has a denier of about 40 to about 120.

15. The blank according to claim 10, wherein said welt comprises an elastomeric yarn.

16. The blank according to claim 15, wherein said elastomeric yarn has a denier of about 120 to about 420.

17. The blank according to claim 10, wherein said first fabric segment is of a different fabric type than said second fabric segment.

18. The blank according to claim 17, wherein said first fabric segment is of a fabric type chosen for its aesthetic appeal and durability and said second fabric segment is of a fabric type chosen for comfort and performance.

19. A method of making a lower torso garment comprising the steps of:

knitting a generally tubular lower torso garment blank having: (1) a circularly knit welt, (2) a circularly knit first fabric segment seamlessly joined to said welt, and (3) a circularly knit, tubular second fabric segment seamlessly joined to said welt, said second fabric segment having an upper edge with at least two portions thereof sewn together;

cutting and removing areas of said upper edge of said second fabric segment to define leg openings therethrough;

forming an outer fabric layer from said first fabric segment; and forming an inner fabric layer from said second fabric segment, whereby a lower torso garment is produced having an integral panty.

20. The method according to claim 19, wherein said first fabric segment is of a different fabric type than said second fabric segment.

21. A lower torso garment comprising:

a circularly knit turned welt having a torso encircling shape;

a circularly knit outer fabric layer seamless joined to said turned welt, and having a lower torso encircling shape, and having an edge opposite and turned welt; and a circularly knit inner fabric layer seamlessly joined to said turned welt, and having a lower torso encircling shape, and having an edge opposite said turned welt, wherein an integral panty without any seams along the torso encircling shape of said inner and outer fabric layers is formed.

* * * * *